United States Patent [19]

Saunders

[11] Patent Number: 4,570,941

[45] Date of Patent: Feb. 18, 1986

[54] BROADHEAD ASSEMBLY FOR ARROW

[75] Inventor: Charles A. Saunders, Columbus, Nebr.

[73] Assignee: Saunders Archery Company, Columbus, Nebr.

[21] Appl. No.: 644,243

[22] Filed: Aug. 27, 1984

Related U.S. Application Data

[63] Continuation-in-part of Ser. No. 375,487, May 6, 1982, Pat. No. 4,468,038.

[51] Int. Cl.[4] ..... F41B 5/02

[52] U.S. Cl. ..... 273/422; 30/303; 30/337

[58] Field of Search ..... 273/422, 421; 30/302, 30/303, 337

[56] References Cited

U.S. PATENT DOCUMENTS

| | | | |
|---|---|---|---|
| 1,250,676 | 12/1917 | Sergerc | 30/302 |
| 1,365,118 | 1/1921 | Meyers | 30/302 |
| 2,350,581 | 6/1944 | Boose | 273/421 |
| 4,029,319 | 6/1977 | Christen | 273/422 |
| 4,036,499 | 7/1977 | Sherwin | 273/422 |
| 4,146,226 | 3/1979 | Sorensen | 273/422 |
| 4,349,202 | 9/1982 | Scott | 273/422 |

*Primary Examiner*—Paul E. Shapiro
*Attorney, Agent, or Firm*—Michael G. Berkman

[57] ABSTRACT

An improved broadhead assembly for an arrow includes a lightweight hollow hub which is affixed to the arrow shaft through a mounting shaft and sleeve retainer. The lightweight hub is tapered toward the front and includes a broadhead blade receiving slot on the leading end thereof shaped to receive a plurality of such broadhead blades. These broadhead blades are adapted to be retained by the hub slot and extend forwardly thereof to provide a broadhead point which slashes into a target differently than a point, which punches at a target. In one embodiment, the plurality of broadhead blades includes a pair of opposed primary blades having frontal tip portions positioned in overlying relation for added tip strength, and a pair of opposed secondary blades having tip portions adapted to tangentially abut the side of an adjacent primary blade tip while extending substantially to the forward point of the primary blade tip. In a second embodiment, three secondary blades meet by abutting each other to define the broadhead point. In a third embodiment, both the primary and secondary blades overlap and interlock for added strength. In all three embodiments, the complete broadhead blades may be removed and replaced.

3 Claims, 13 Drawing Figures

FIG. 10
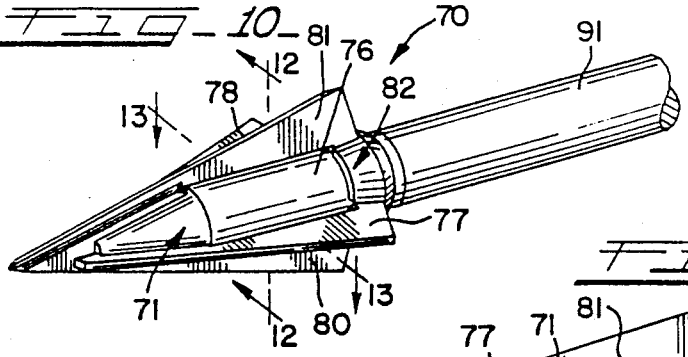
FIG. 12
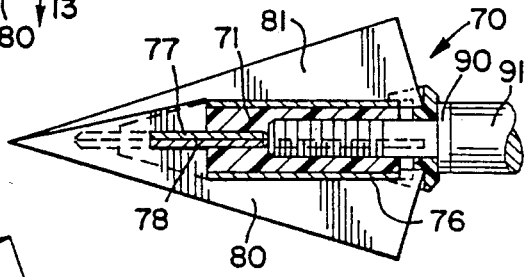
FIG. 11
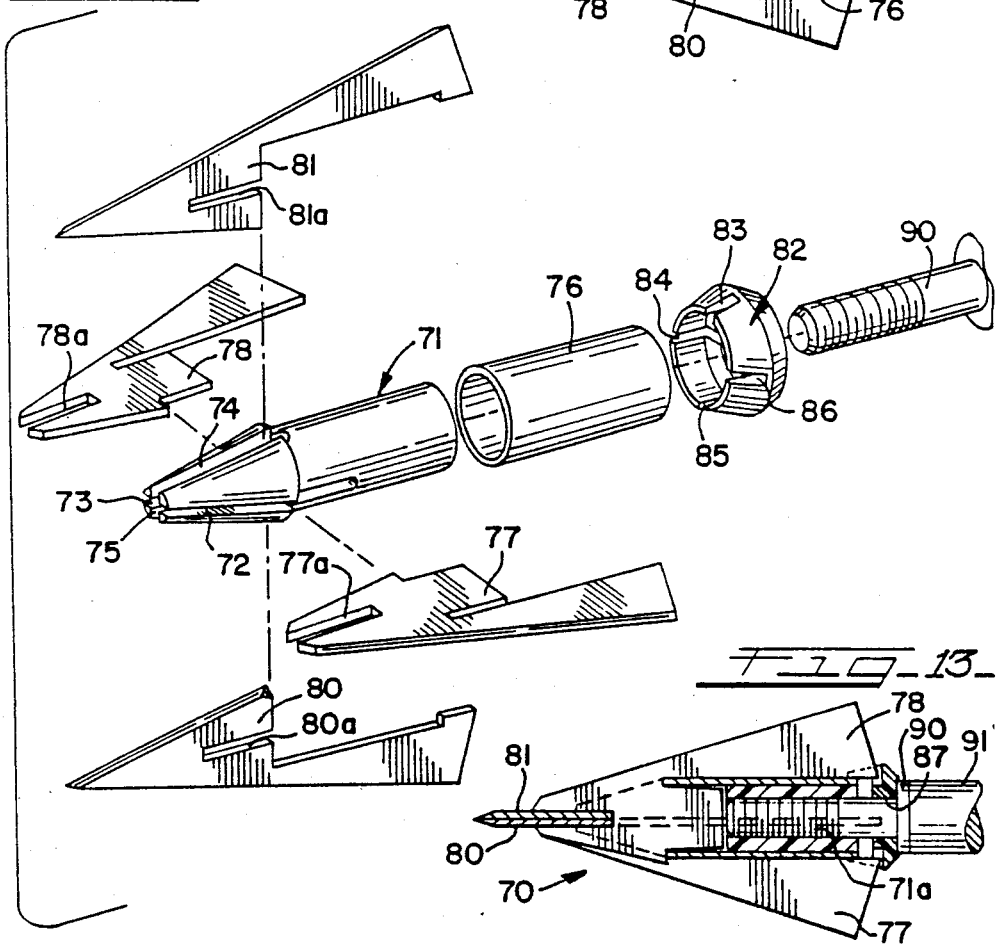
FIG. 13

BROADHEAD ASSEMBLY FOR ARROW

Background Of The Invention

The application is a continuation-in-part of application Ser. No. 375,487, filed May 6, 1982, now U.S. Pat. No. 4,468,038.

The invention relates to broadhead hunting arrows, and more particularly to an improved broadhead assembly providing completely removable broadhead blades which extend in front of a broadhead hub assembly to define the tip of the broadhead. Such an assembly provides a slashing action when entering a target, rather than a punching action.

Heretofore, arrowheads of the broadhead type having removable razor-edge blades extending radially outwardly of a central hub to which they are attached have been of the type wherein the hub extends to the frontmost point of the arrowhead, i.e., the tip of the broadhead arrow has been an integral part of the hub assembly therefor. Such construction is shown in U.S. Pat. No. 2,373,216 issued to C. J. Zwickey Apr. 10, 1945; and U.S. Pat. No. 2,880,000, issued to H. F. Unger Mar. 31, 1959. In such assemblies, the frontal tip of the broadhead is a separate part from the removable blades therefor. In other broadhead construction, the frontal tip of the broadhead is a conical punching-type tip with the broadhead blades starting behind the conical punching portion. In this type of blade, there is a punching action as the tip enters the target, rather than a preferred slashing action.

Additional hunting arrowheads are disclosed in U.S. Pat. Nos. 1,604,713; 2,005,424; 2,182,320; 2,796,691; 3,578,328; 3,164,385; and 3,945,642.

It is therefore an object of the present invention, generally stated, to provide an improved broadhead assembly for detachably mounting broadhead blades on a hub thereof where the broadhead blades extend forwardly of the hub to create a slashing point, with blades therefore being interchangeable.

Another object of the present invention is the provision of an improved broadhead arrow assembly including a lightweight tubular hub therein which is adapted for receiving and retaining replaceable broadheads adjacent a leading end thereof to define a slashing type point made up completely of interchangeable blades.

SUMMARY OF THE INVENTION

The invention is directed to an improved broadhead assembly for an arrow which includes a hub assembly adapted for retention on the leading end of an arrow shaft. A plurality of broadhead blades are mountable in even arcuate relation on the hub assembly and extended radially outwardly therefrom. In the improvement, a leading end of the hub includes a slot means axially therein adapted for receiving a forward mounting portion of each broadhead blade, and the leading point or tip of each blade extends forwardly of the leading end of the hub.

BRIEF DESCRIPTION OF THE DRAWINGS

The features of the present invention, which are believed to be novel, are set forth with particularity in the appended claims. The invention may best be understood from the following detailed description of currently preferred embodiments thereof taken in conjunction with the accompanying drawings, wherein:

FIG. 10 is a perspective view of a second modification of the present invention utilizing double overlapping blades.

FIG. 11 is an exploded perspective view of the second modification shown in FIG. 10.

FIG. 12 is a detailed cross-sectional view taken substantially along line 12—12 of FIG. 10.

FIG. 13 is a detailed cross-sectional view taken substantially along line 13—13 of FIG. 10.

DETAILED DESCRIPTION OF THE PREFERRED EMBODIMENTS

Figure 1:
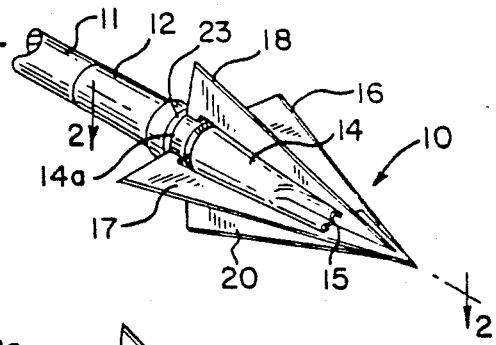
FIG. 1 is a perspective view of an improved broadhead arrow assembly constructed in accordance with the present invention.
Figure 3:
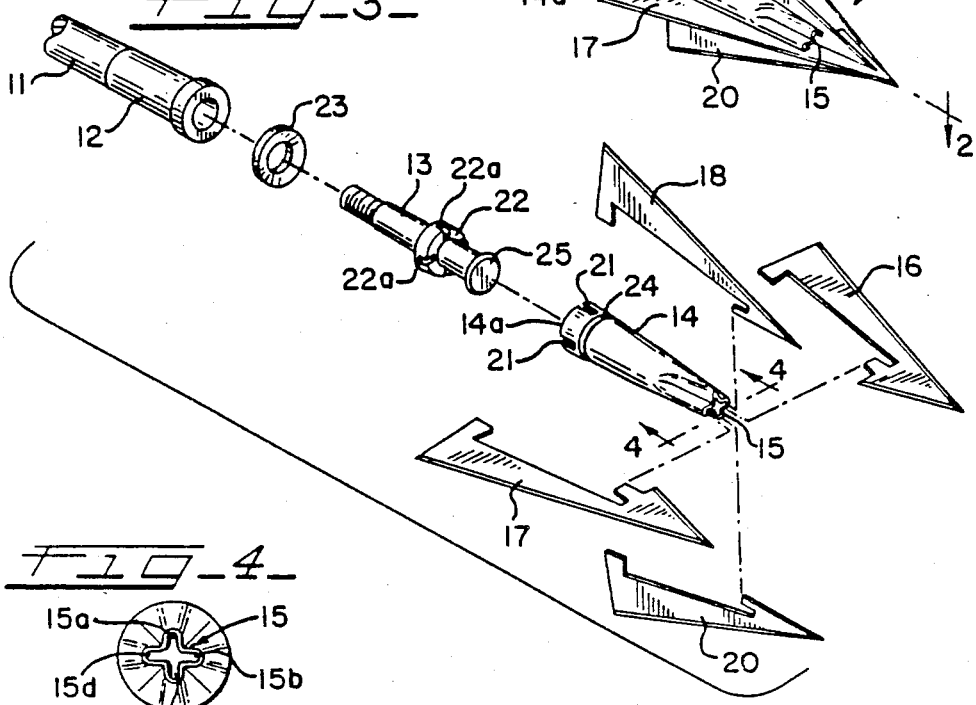
FIG. 3 is an exploded perspective view of the broadhead arrow assembly shown in FIG. 1.

Referring to FIGS. 1, 2, 3 and 4, a preferred four-blade embodiment of the present invention, generally indicated at 10, is affixed on a female sleeve 12 at the end of an arrow shaft 11 by means of a mounting shaft 13 which is preferably press fit into the open back end of a hollow tubular hub 14. Tubular hub 14 has a cross-shape slotted portion 15 at the leading end thereof, including ridges 15*a*, 15*c* and 15*d*, into which are retained opposing pairs of primary broadhead blades 16–17, and secondary broadhead blades 18–20. Ridges 15*a* and 15*c* are preferably one-half the width of ridges 15*b* and 15*d*. The rear of each of the blades is received in a slot 21—21 at the rear of hub 14 where it is retained therein by means of an annular grommet 22 and a belleville washer 23. Hub 14 further includes an annular recess 24 into which the radially outwardly flanged end 25 of shaft 13 is press fit and retained thereby.

Figure 5:
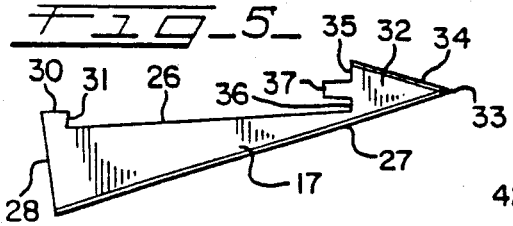
FIG. 5 is a side elevational view of a primary broadhead blade.

As shown most clearly in FIG. 5, each primary blade, as in blade 17, includes a base edge 26 adapted to abut the outer circumference of hub 14, a long razor edge side 27, and a trailing edge 28. The inwardmost portion of edge 28 bounds a retaining detent 30 positioned rearward of base 26 for retaining the back end of the blade in grommet 22, and, in this embodiment, in slot 21. The forward edge 31 of detent 30 is acutely angled with base 26 so as to be retained at the rear of the hub once the blade is put in mounted position.

The forward tip portion 32 of a primary blade 17 is triangulated so as to extend across the axis of the arrow shaft and provide additional strength to the distal slashing tip 33 at the juncture of razor edge 27 and an opposing side 34. In this embodiment edge 34 may also be razor edged if desired. If it is not to be razor edged, it should be recessed slightly as shown most clearly in FIG. 2. Rearwardly of leading tip 33 on blade 17 are positioned bifurcated back edges 35–36 which are split by a detent 37 sized to fit across one of the cross-shaped slot portions 16, such as ridges 15*b*, 15*d*, shown most clearly in FIG. 4. With detent 37 fitted on slot 15, rear sides 35, 36 abut against the outer periphery of slot 15 to retain the primary broadhead in the slot. The overlying relation of the forward tip portions of respective primary blades 16–17 fills slot ridges 15*b*, 15*d*, thus adding strength and rigidity to the broadhead.

Figure 6:
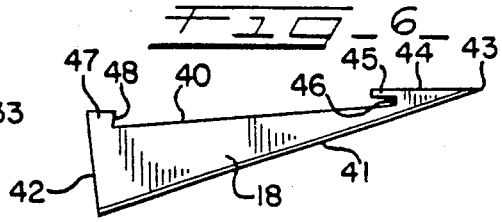
FIG. 6 is a side elevational view of a secondary broadhead blade.

As shown most clearly in FIG. 6, each secondary blade, such as shown at 18, includes a base side 40 which is adapted to abut the outer circumference of hub 14 in an axial direction and a long razor edge 41 which extends from a back trailing side or edge 42 to a frontal tip 43. Unlike the primary blades 16–17, front tip 43 does not extend across the axis of the arrow, but has an opposing side or edge 44 substantially parallel to the axis of the arrow. The rearwardmost portion of side 44 forms a partial boundary of a detent 45 which is connected with base side 40 by a relief recess 46. The trailing edge 42 of secondary blade 18 likewise defines a portion of a rear detent 47 having an acutely angled surface 48 with the base 40 for retaining the rear of the blade on hub 14 through slot 21 and slotted grommet 22. In operation, the primary opposing blades 16–17 are positioned on hub 14, and each secondary blade is fitted tangentially to the plane of the primary blades with detent 45, for example, fitting in slot 15*a* or 15*c*. Thereafter, rear detent 47 is positioned through slot 21 into a recess on grommet 22. Likewise, the opposing secondary blade is positioned on the opposing side of hub 14, and after all the rear detents are in position on hub 14, the sleeve 12 is turned on shaft 13 to abut the belleville washer 23 against the trailing edges of the respective blades and retain same on hub 14. As shown most clearly in FIGS. 2, 5 and 6, the preferred orientation of primary and secondary blade trailing edges 28 and 42, respectively, is at an acute angle with the axis of the arrow and aligned with the frustoconical shape of belleville washer 23.

It should be noted that slots 21—21 in the back of hub 14 and slots 22*a*—22*a* formed partially radially into grommet 22 at intervals therearound grasp and retain the rear detents of the respective primary and secondary blades when same are tightened onto the arrow shaft sleeve 12. Slots 21—21 may be eliminated and the axial thickness of the grommet 22 increased so that a tightened grommet and rear annular edge 14*a* of hub 14 would retain the blade detents 30–47. Also, grommet 22 serves to absorb some of the shock which the broadhead blades receive upon striking a target. The flexure capability of the grommet, and the use of the beveled belleville washer 23, absorb much of the shock of the broadhead tip hitting the target and also transfer some of that shock to the arrow shaft 11 and sleeve 12.

Figure 4:
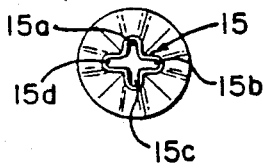
FIG. 4 is an end elevational view taken substantially along line 4—4 of FIG. 3.
Figure 2:
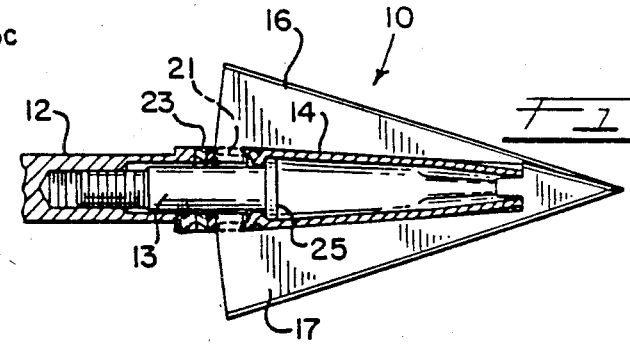
FIG. 2 is a detailed cross-sectional view, on enlarged scale, taken substantially along line 2—2 of FIG. 1.
Figure 7:
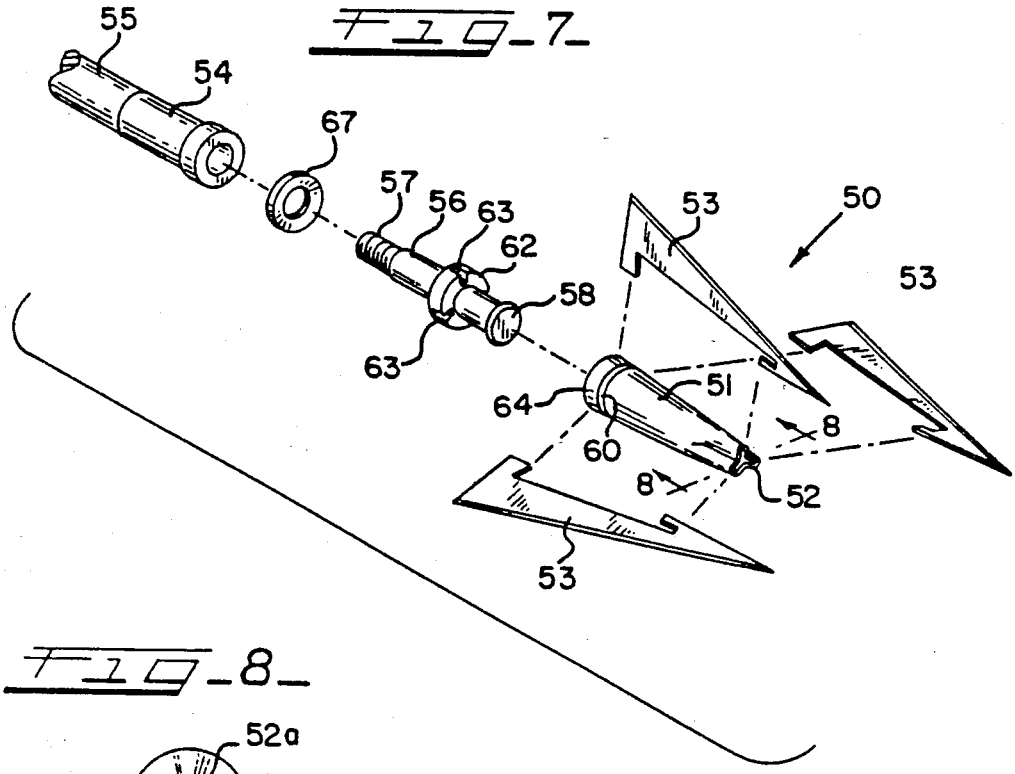
FIG. 7 is an exploded view similar to FIG. 3 of a modification of the present invention utilizing three blades.
Figure 8:
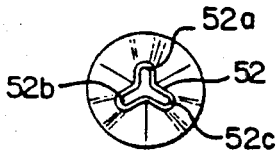
FIG. 8 is an end elevational view taken substantially along line 8—8 of FIG. 7.

Referring to FIG. 7, a modification of the broadhead assembly of the present invention, generally indicated at 50, includes a hub 51 similar to hub 14 with exception that front slot 52, shown most clearly in FIG. 8, is a Y-shape having three substantially identical shaped nodules 52*a*, 52*b*, and 52*c*, rather than the four nodule cross shape shown in FIG. 4. Also, the rear of hub 51 has no axially oriented slots therein. Further, the broadhead blades of the modification are characterized as three blades 53—53—53 substantially identical to the secondary blades 18–20 of the first embodiment. As with the first embodiment, a broadhead retaining sleeve 54 is mounted on the forward end of an arrow shaft 55 and maintained on hub 51 by means of mounting shaft 56 having a threaded end 57 which fits in the sleeve 54 and a radially extending flange 58 which is press fit under recess 60 on hub 51 and retained thereby. In this embodiment, the grommet 62 having slots 63—63 therein is axially longer than grommet 22, thus extending rearwardly of the rear edge 64 of hub 51.

Figure 9:
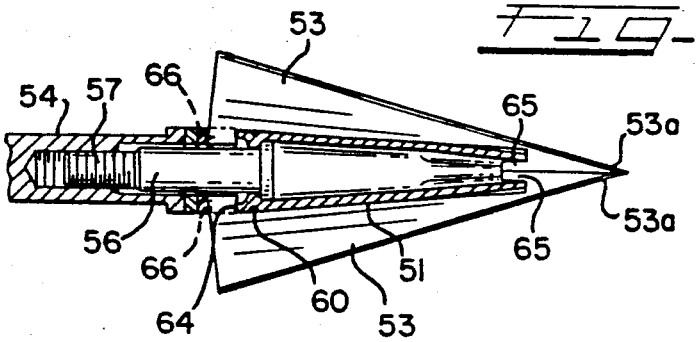
FIG. 9 is a sectional view of the first modification of the present invention shown in FIG. 7, as assembled.

As shown most clearly in FIG. 9, each broadhead blade 53 has a mounting detent 65—65 which is maintained in one of three forks of Y-slot 52 at 120-degree angles relative their adjacent blades. The rear detent 66—66 of each blade is received in a slot 53—53 extending partially radially inward of grommet 62 at intervals therearound and tightened thereon by belleville washer 67 when mounting shaft 56 is turned on sleeve 54. In this embodiment, the forward tip 53*a* of each blade meets and abuts the adjoining blades to form the slashing tip of the broadhead blade assembly, thus providing a lightweight efficient triple blade broadhead wherein the slashing points thereof may be completely interchanged by replacing any or all of the three broadhead blades.

Referring to FIGS. 10–13, a second modification of the broadhead blade assembly of the present invention, generally indicated at 70, includes a hub 71 generally similar to hubs 14 and 51 with the exception that it is formed of a lightweight resilient material and includes opposing primary slots 72–73 therein and opposing secondary blade slots 74, 75 positioned normal to the primary blade slots. The front portion of hub 71 is tapered similarly to the previously described hubs and the rear portion of 71 is cylindrical and sized to snuggly fit within a cylindrical sleeve 76 which preferably is made of metallic material to provide added strength and rigidity to hub 71. In this embodiment, opposing secondary blades 77, 78 are mounted on hub 71 first by overlapping same in slits 72–73. Thereafter, primary blades 80, 81 are positioned in overlapping relation in slots 74 and 75 and moved axially rearwardly such that the bottom portions of retaining slots 80, 80A and 81A engage the bottom of correspondingly aligned slots 77A and 78A to interlock the respective pairs of primary and secondary blades unto hub 71 and strengthening sleeves 76. Thereafter, the rearmost portions of the secondary blades 77, 78, and primary blades 80, 81 are retained by a cup shape cap 82 having slots 83, 84, 85 and 86 positioned therein to retain the blades thereon while the cap fits over the rearward most portions of hub 71 and sleeve 76.

As shown most clearly in FIGS. 12 and 13, hub 71 has a threaded bore 71a axially therethrough and cup shape cover 82 includes an aperature 87 axially therethrough. The combination of the hub 71 sleeve 76 blades 77, 78, 80 and 81 and cover 82 are then threaded onto a threaded mounting shaft 90 which is retained on the end of an arrow shaft 91.

As shown clearly in FIGS. 10–13, the four-blade double overlapped broadhead assembly of the second modification is an extremely strong front slashing portion wherein both sets of removable primary and secondary blades are overlapped and fitted in sleeve 71 to provide substantial strength to the slashing broadhead assembly. Also, the utilization of shock absorbing rubber-plastic materials in hub 71 and rear cover 82 provide "give" to the blade assembly to make the assembly not only slashingly sharp, but also tough and resilient in use.

While three embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

The invention is claimed as follows:

1. In a broadhead assembly for an arrow, said broadhead assembly being of the type including a hub assembly adapted for being retained on the leading end of an arrow shaft, and opposing pairs of broadhead blades mountable in perpendicular relation on said hub assembly and extending radially outwardly therefrom; an improvement wherein said hub assembly includes a central hub with a leading end of said hub having slot means extending axially therein for receiving a forward mounting portion of each said blade, the leading point of each said blade extending forwardly of said leading end of said hub, said opposing pairs of broadhead blades including a pair of primary opposing blades having ends thereof adapted for juxtaposed overlying relation for added strength to the tip of said broadhead, and a pair of secondary opposing blades also adapted for juxtaposed overlying relation and each having a leading end thereof adapted for abutting a side of a primary blade adjacent said leading end thereof.

2. The broadhead assembly as defined in claim 1 wherein said hub assembly includes a tubular member sized for fitting over said hub rearwardly adjacent said leading end thereof for covering a rear portion of at least one of said slots, and each of said secondary blades including a detent portion sized to fit into said one slot and be retained therein by said portion of said tubular, member covering said rear portion thereof.

3. The broadhead assembly as defined in claim 1 wherein each of said secondary blades includes a notch or open recess extending rearwardly from a forward most portion of said blade for receiving and retaining therein and perpendicularly thereto a forward portion of each of said primary blades.

* * * * *